US007505005B2

(12) United States Patent
Mellage et al.

(10) Patent No.: US 7,505,005 B2
(45) Date of Patent: Mar. 17, 2009

(54) CUSTOMIZABLE ANTENNA STRUCTURE

(75) Inventors: Brian Francis Mellage, Raleigh, NC (US); Curtis Wayne Thornton, Raleigh, NC (US); Gerard James Hayes, Wake Forest, NC (US)

(73) Assignee: Sony Ericsson Mobile Communications AB, Lund (SE)

( * ) Notice: Subject to any disclaimer, the term of this patent is extended or adjusted under 35 U.S.C. 154(b) by 67 days.

(21) Appl. No.: 11/307,833

(22) Filed: Feb. 24, 2006

(65) Prior Publication Data

US 2007/0171135 A1 Jul. 26, 2007

Related U.S. Application Data

(60) Provisional application No. 60/766,456, filed on Jan. 20, 2006.

(51) Int. Cl.
*H01Q 1/24* (2006.01)

(52) U.S. Cl. ..... 343/702; 343/720

(58) Field of Classification Search ..... 343/702, 343/720

See application file for complete search history.

(56) References Cited

U.S. PATENT DOCUMENTS

| | | | | |
|---|---|---|---|---|
| 5,258,768 | A * | 11/1993 | Smith | 343/786 |
| 6,717,801 | B1 | 4/2004 | Castell et al. | |
| 7,277,064 | B2 * | 10/2007 | Hogsett | 343/872 |
| 7,284,704 | B2 * | 10/2007 | Lubow | 235/462.01 |
| 2004/0227679 | A1 * | 11/2004 | Lu | 343/702 |
| 2006/0082510 | A1 * | 4/2006 | Eckstein et al. | 343/720 |
| 2007/0200785 | A1 * | 8/2007 | Courtney | 343/872 |

FOREIGN PATENT DOCUMENTS

| | | |
|---|---|---|
| EP | 1508938 | 2/2005 |
| EP | 1280229 | 2/2007 |
| JP | 58100505 | 6/1983 |

OTHER PUBLICATIONS

Sony Ericsson Mobile Communications AB, International Application No. PCT/US06/37437, "International Search Report", Jan. 24, 2007.

Sony Ericsson Mobile Communications AB, International Application No. PCT/US06/37437, "Written Opinion", Jan. 24, 2007.

International Preliminary Report on Patentability, corresponding to International Patent Application No. PCT/US2006/037437, dated Jul. 31, 2008.

* cited by examiner

*Primary Examiner*—Tan Ho
(74) *Attorney, Agent, or Firm*—Frederick D. Bailey; Moore & Van Allen, PLLC

(57) ABSTRACT

An antenna structure is comprised of a body, an antenna element coupled with the body, and an arm support coupled with the body and the antenna element. The arm support also includes a recessed portion on one side adapted to receive a two-sided customizable plate. The customizable plate is made of a non-metallic material. The customizable plate is further adapted to fit within the recess and can be adhered to the recessed portion of the arm support. The customizable plate can also be graphically customized to display a viewable image. In addition, the customizable plate can be imprinted with a metallized pattern on the side that faces the recessed portion when seated in the arm support. The imprinted metallized pattern can beneficially affect the performance characteristics of the antenna element.

10 Claims, 5 Drawing Sheets

CUSTOMIZABLE ANTENNA STRUCTURE

CROSS-REFERENCE TO RELATED APPLICATIONS

The present application is derived from and claims the benefit of U.S. Provisional Patent Application No. 60/766,456 filed Jan. 20, 2006.

BACKGROUND

Customers frequently require that PC Card or other mobile device antennas be customized to display their colors, logos, company name, or the like. This provides an additional opportunity for branding and brand recognition.

For the antenna suppliers, this adds tooling costs and longer lead times to meet such requests since the antennas are typically individually branded at the time of manufacture. The antenna manufacturer must utilize a customized tool for each brand. This tool must be integrated into the antenna fabrication process and switched out for each new customer/brand. The whole process is beset with inefficiencies, additional costs, and lost time which is ultimately put upon the end consumer.

SUMMARY

The present invention addresses the above stated problem by including a support arm that is coupled with the antenna body and antenna element. The support arm includes a recessed portion adapted to receive and seat a customizable plate fabricated from plastic or some other rigid easily manufactured non-conducting material. The customizable plate can be individually branded upon request of a customer. In addition, the support arm provides an additional measure of stability, rigidness, and strength to the overall antenna design. The customizable plate itself is non-conducting and would not alter the performance characteristics of the antenna. However, in an alternate embodiment, the customizable plate can be imprinted with a metallized pattern on the inside surface which would be the non-visible side of the customizable plate when it is seated in the recessed portion of the support arm. The metallized pattern can be designed to enhance the intended antenna properties as well as providing for additional applications, including but not limited to, GPS reception and WLAN reception.

According to one embodiment of the present invention, there is disclosed an antenna structure. The antenna structure comprises a body, an antenna element coupled with the body, and an arm support coupled with the body and the antenna element. The arm support substantially fills most of the space created by the antenna element. The arm support also includes a recessed portion on one side adapted to receive a two-sided customizable plate.

The customizable plate is comprised of a non-metallic material that does not affect the performance characteristics of the antenna element. The customizable plate is further adapted to fit within the recess and can be adhered to the recessed portion of the arm support. The customizable plate can also be graphically customized to display a viewable image. In addition, the customizable plate can be imprinted with a metallized pattern on the side that faces the recessed portion when seated in the arm support. The imprinted metallized pattern beneficially affects the performance characteristics of the antenna element.

According to another embodiment of the present invention, there is disclosed an arm support for an antenna structure. The arm support can be coupled with the antenna structure that is comprised of a body and an antenna element. The arm support is comprised of a nonmetallic material having a recessed portion on one side adapted to receive a two-sided customizable plate.

The customizable plate is adapted to fit within the recessed portion can be adhered the recess of the arm support. The customizable plate can also be graphically customized to display a viewable image. In addition, the customizable plate can be imprinted with a metallized pattern on the side that faces the recessed portion when seated in the arm support. The imprinted metallized pattern beneficially affects the performance characteristics of the antenna element.

According to yet another embodiment of the present invention, there is disclosed a customizable plate for use with an antenna structure. The customizable plate is adapted to fit within a recessed portion of an arm support that is part of the antenna structure. The customizable plate can also be graphically customized to display a viewable image. In addition, the customizable plate can be imprinted with a metallized pattern on the side that faces the recessed portion when seated in the arm support. The imprinted metallized pattern beneficially affects the performance characteristics of an antenna element that is part of the antenna structure.

DETAILED DESCRIPTION

Figure 1:
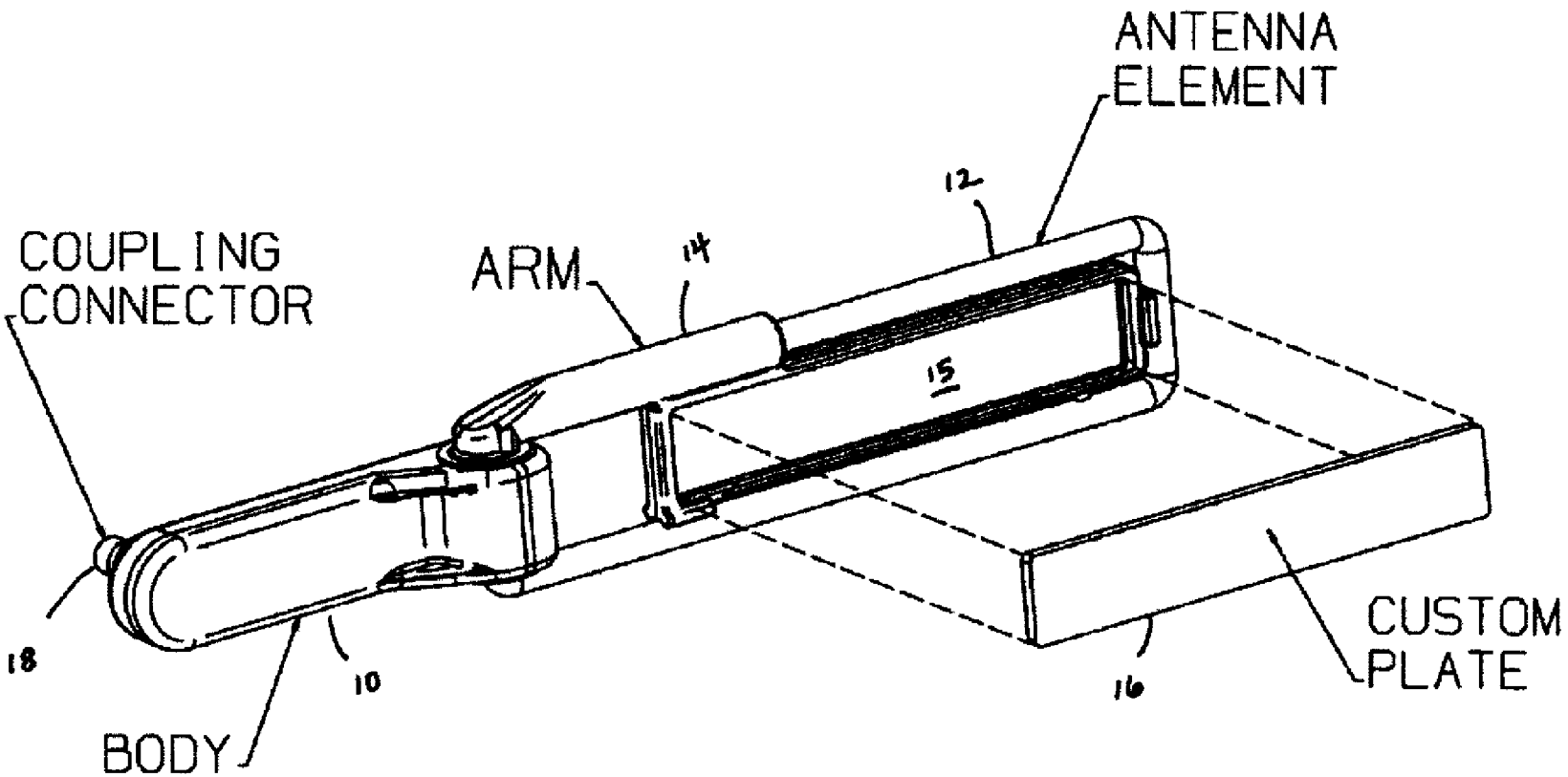
FIG. 1 illustrates an antenna and its components according to the present invention.

FIG. 1 illustrates an antenna structure and its components according to an embodiment of the present invention. The antenna structure includes a body 10 coupled with a metallic antenna element 12 much like existing prior art. The present invention further includes an arm support 14 that is coupled to both the body 10 and antenna element 12. The dual coupling arrangement on arm support 14 provides an increased measure of stability, strength, and rigidity to the overall antenna structure in that it fills in most of the space created by the antenna element 12 and also connects the end of the antenna element 12 back to the body 10. A coupling connector 18 is also shown. The coupling connector 18 provides an interface point between the antenna structure and the RF electronics (not shown) for a transmitter, receiver, or transceiver.

The arm support 14 further includes a slight recess 15 covering a substantial portion of one side of the support arm 14. Recess 15 is adapted to receive and seat a customizable plate 16. The customizable plate 16 is designed to fit snugly into the recess 15 of the arm support 14. It can be held in place using some kind of adhesive that is well known in the art.

The customizable plate 16 and arm support 14 are fabricated from a non-metallic material such as plastic so as to not interfere with the performance characteristics of the antenna element 12. The customizable plate can then be customized to reflect the name or logo of a customer. Any design can be integrated directly onto the customizable plate 16 or can be in the form of an adhesive sticker that can be affixed to the customizable plate 16.

Using the above described antenna structure allows the antenna manufacturer/supplier to make a single antenna without having to customize the tools or machines for different logos or designs. The tools or machines that make the customizable plate 16 are the only items that would require adjustments for different customers. Even this can be avoided if the customizable plate 16 were to utilize a sticker that could be affixed thereon. The sticker could also be affixed directly within the recess 15. A customizable sticker could also remove the need for there to be a recess 15 on the arm support 14 since it could be affixed directly to a surface of the arm support 14. Use of a recess 15 on the arm support 14 is advantageous because it makes it more difficult for a sticker to peel away since the edges of the sticker would not be as exposed.

Figures 2A, 2B, 2C:
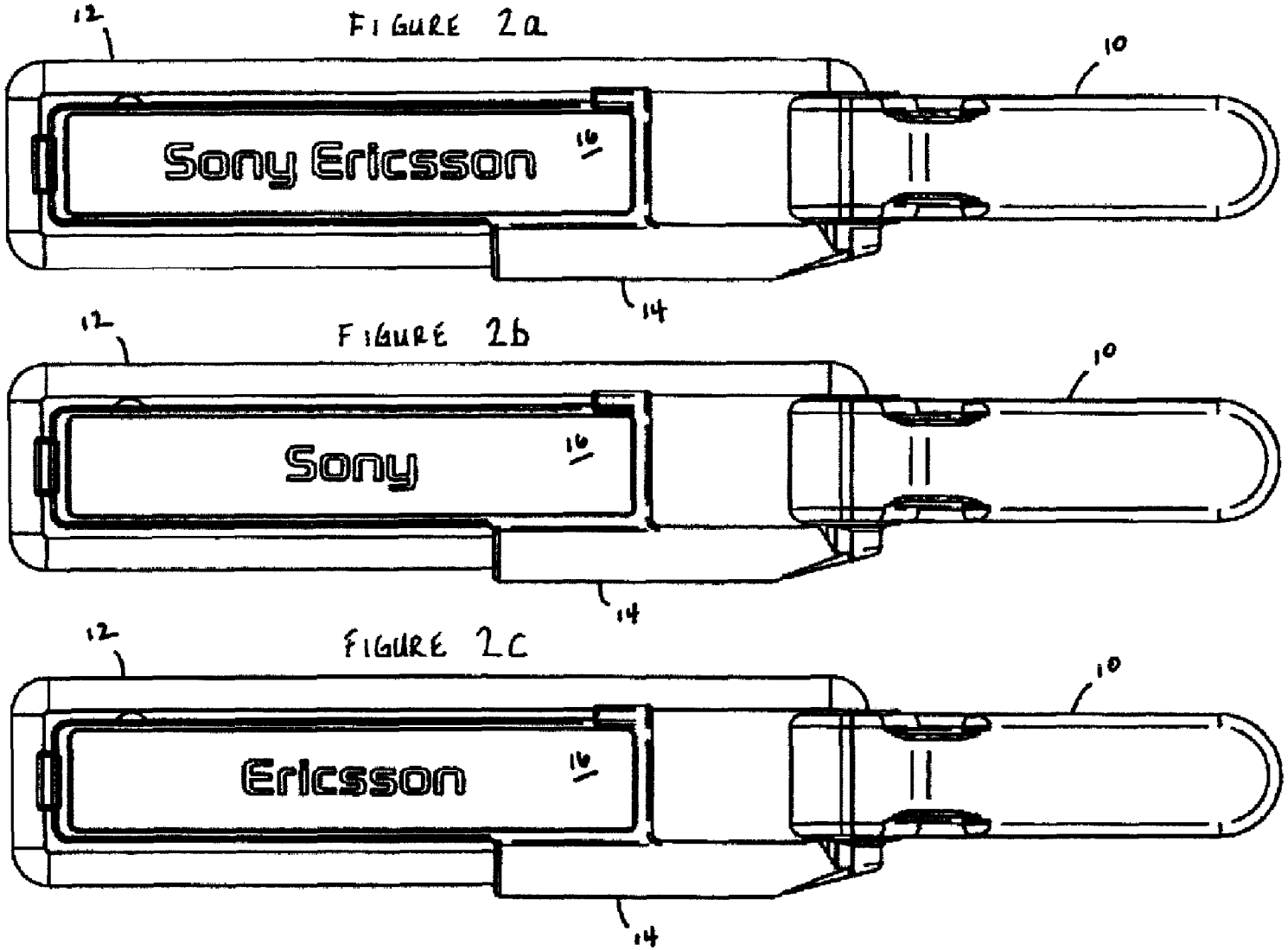
FIGS. 2*a*-2*c* illustrate the use of different customizable plates with the antenna structure of FIG. 1.

FIGS. 2*a*-2*c* illustrate the use of different customizable plates 16 with the antenna structure of FIG. 1. These figures show that the same exact antenna structure can be customized for multiple customers without having to alter the manufacturing process for the actual antenna structure. For instance, in FIG. 2*a* the customizable plate 16 bears the logo for Sony Ericsson™, while in FIG. 2*b* the customizable plate 16 bears the logo for Sony™, and in FIG. 2*c* the customizable plate 16 bears the logo for Ericsson™. Thus, the antenna manufacturer can accommodate multiple clients without having to retool. The antenna manufacturer need only make or contract to have made the customizable plate 16 portion of the antenna structure on a case-by-case basis. This significantly reduces the cost and time required to make and deliver the antenna structure.

Moreover, the customizable plate 16 can also be used to enhance the antenna properties of the antenna structure. The customizable plate 16 can be imprinted with a metallized pattern on the inside surface which would be the non-visible side of the customizable plate when it is seated in the recessed portion of the support arm. The metallized pattern can be specifically designed to enhance the intended antenna properties as well as providing for additional applications, including but not limited to, GPS reception and WLAN reception.

FIGS. 3*a*-*d* illustrate several examples of metallization patterns that affect the voltage standing wave ratio (VSWR) characteristics of the basic antenna structure. VSWR is a unitless ratio of the maximum effective voltage to the minimum effective voltage. VSWR can range from one to infinity and expresses the amount of reflected energy. A value of one indicates that all energy will pass through. Higher values indicate that less energy will pass through. Thus, the troughs or valleys in the graph(s) represent frequency bands or ranges of maximum antenna performance while the peaks of the graph represent areas of little or no antenna performance.

There are many frequency bands devoted to cellular communications (voice and data) throughout the world. These frequency bands are generally regulated by governments around the world that issue licenses that permit the use of the frequency spectrum. Certain bands are associated with certain applications. For instance, the Global System for Mobile communications (GSM) standard utilizes occupies multiple bandwidths depending on the country in which a mobile device is being used. There are typically four GSM bandwidths that are centered about 850 MHz, 900 MHz, 1800 MHz, and 1900 MHz. The 1800 MHz and 1900 MHz bandwidths are often times referred to as the Digital Cellular System (DCS) and the Personal Communications Service (PCS) respectively. The Global Positioning System (GPS) has had the frequency band centered about 1575 MHz reserved for its purposes. Similarly, Wireless Local Area Networks (WLAN) operate in the unregulated 2.4 GHz (2400 MHz) frequency range. DCS, PCS, GPS, and WLAN are used on the horizontal axes of the graphs for FIGS. 4 and 5 in lieu of the actual frequency ranges they represent.

Figure 3A:
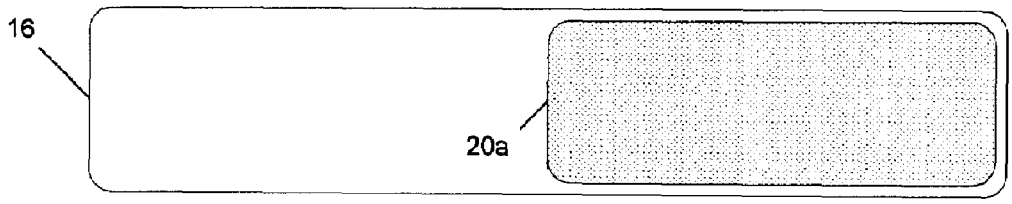
FIG. 3*a* illustrates the metallization pattern designed to enhance frequency coverage as illustrated by the graph in FIG. 4*b*.
Figure 3B:
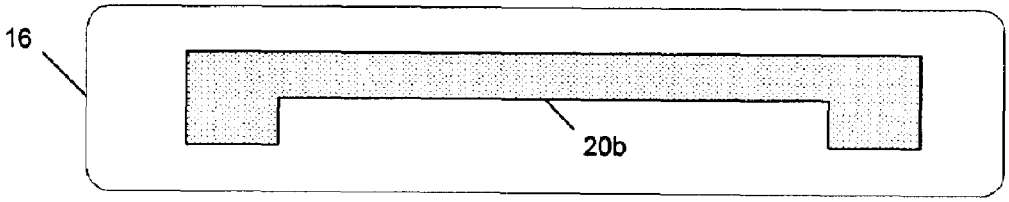
FIG. 3*b* illustrates the metallization pattern designed to provide GPS coverage as illustrated by the graph in FIG. 5*b*.
Figure 3C:
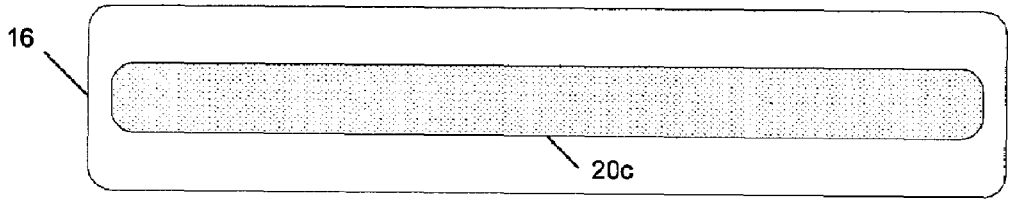
FIG. 3*c* illustrates the metallization pattern designed to provide WLAN coverage as illustrated by the graph in FIG. 5*c*.
Figure 3D:
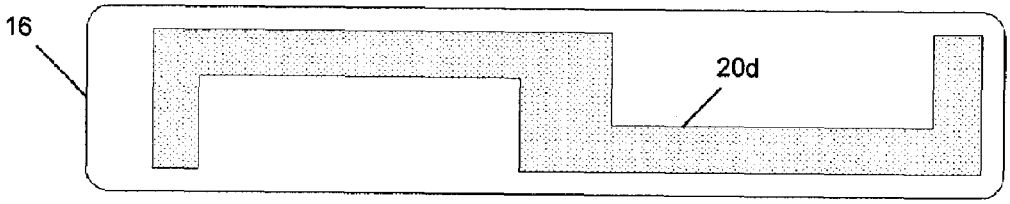
FIG. 3*d* illustrates the metallization pattern designed to provide GPS and WLAN coverage as illustrated by the graph in FIG. 5*d*.
Figure 4A:
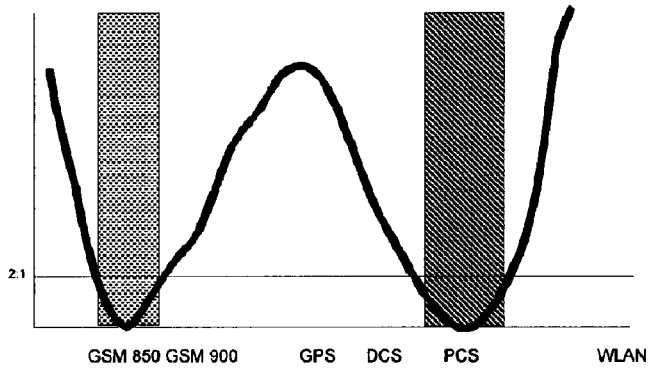
FIG. 4*a* illustrates a sample voltage standing wave ratio (VSWR) for a dual band antenna having a customizable plate without an imprinted metallization pattern.
Figure 4B:
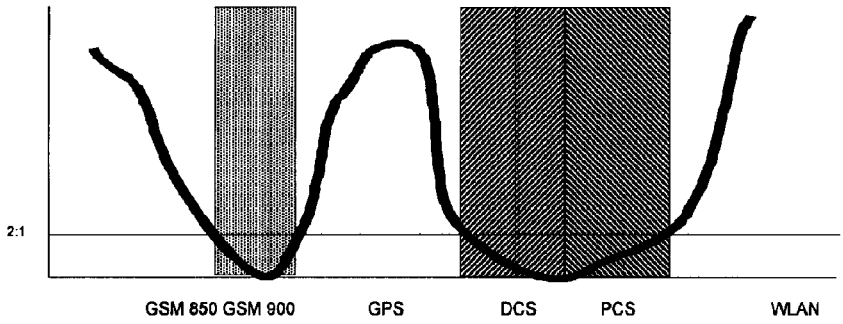
FIG. 4*b* illustrates a sample voltage standing wave ratio (VSWR) for a dual band antenna that has had its customizable plate imprinted with the metallization pattern of FIG. 3*a*.

FIG. 3*a* illustrates the metallization pattern designed to enhance an antenna's frequency coverage as illustrated by the graph in FIG. 4*b*. FIG. 3*b* illustrates the metallization pattern designed to provide GPS coverage for an antenna as illustrated by the graph in FIG. 5*b*. FIG. 3*c* illustrates the metallization pattern designed to provide WLAN coverage for an antenna as illustrated by the graph in FIG. 5*c*. FIG. 3*d* illustrates the metallization pattern designed to provide GPS and WLAN coverage for an antenna as illustrated by the graph in FIG. 5*d*.

FIGS. 4*a* and 4*b* contrast the voltage standing wave ratios (VSWR) for a dual band antenna structure with and without an imprinted metallization pattern affixed to the customizable plate 16.

FIG. 4*a* illustrates a baseline VSWR for a dual band antenna having a customizable plate 16 without an imprinted metallization pattern. This figure illustrates the VSWR of the intended (unaltered) dual band antenna design. The graph indicates that the antenna maximizes reception in the GSM frequency bands centered around 850 MHz and 1900 MHz (PCS).

FIG. 4*b* illustrates a VSWR for a dual band antenna that has had its customizable plate 16 imprinted with the metallization pattern 20*a* of FIG. 3*a*. The metallization pattern 20*a* is designed to allow the antenna to provide greater frequency coverage including the DCS band. In this example, the metallized pattern 20*a* imprinted on the back of the customizable plate 16 changes the frequency characteristics of the antenna structure. As indicated by the troughs in the graph, reception has been maximized for GSM frequency bands around 900 MHz, 1800 MHz (DCS), and 1900 MHz (PCS).

FIGS. 5*a* through 5*d* contrast the voltage standing wave ratios (VSWR) for a quad band antenna structure with and without an imprinted metallization patterns affixed to the customizable plate 16.

Figure 5A:
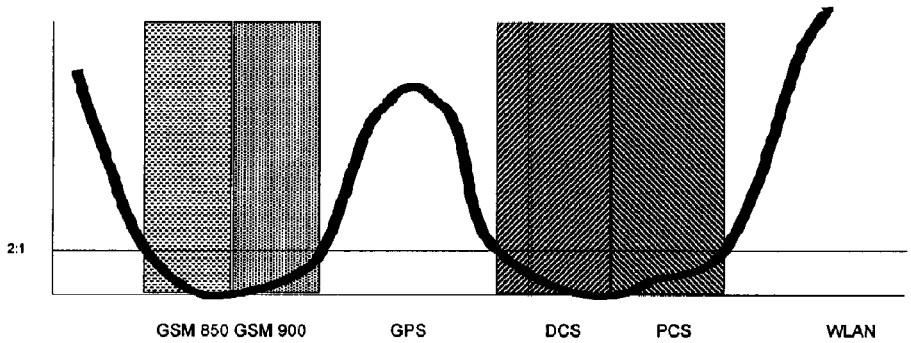
FIG. 5*a* illustrates a sample voltage standing wave ratio (VSWR) for a quad band antenna having a customizable plate without an imprinted metallization pattern.

FIG. 5*a* illustrates a baseline VSWR for a quad band antenna having a customizable plate 16 without an imprinted metallization pattern. This figure illustrates the VSWR of the intended quad band antenna design. The graph indicates that the antenna has been designed to maximize reception in the GSM frequency bands around 850 MHz, 900 MHz, 1800 MHz (DCS), and 1900 MHz (PCS) without the assistance of a metallized pattern on the customizable plate 16.

Figure 5B:
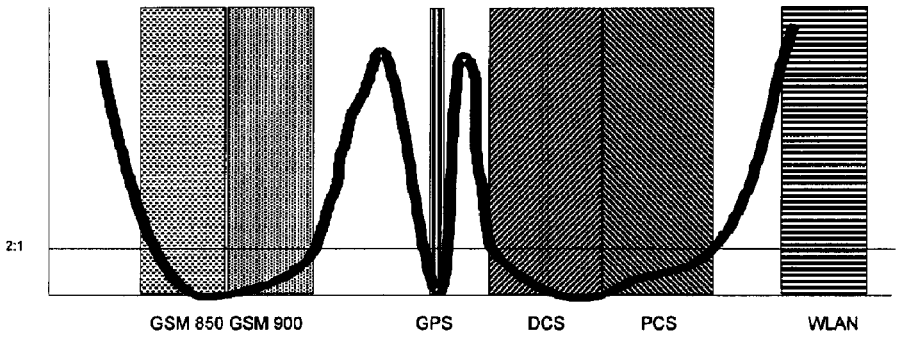
FIG. 5*b* illustrates a sample voltage standing wave ratio (VSWR) for a quad band antenna that has had its customizable plate imprinted with the metallization pattern of FIG. 3*b*.

FIG. 5*b* illustrates a VSWR for a quad band antenna that has had its customizable plate 16 imprinted with the metallization pattern 20*b* of FIG. 3*b*. This metallization pattern 20*b* is designed provide additional antenna coverage for GPS frequency reception. In this example, the metallized pattern 20*b* imprinted on the back of the customizable plate 16 changes the frequency characteristics of the antenna structure. In addition to the GSM frequency bands around 850 MHz, 900 MHz, 1800 MHz (DCS), and 1900 MHz (PCS), the graph shows that the metallized pattern 20*b* also provides for reception around 1575 (MHz) which is a frequency utilized by global positioning system (GPS) satellites.

Figure 5C:
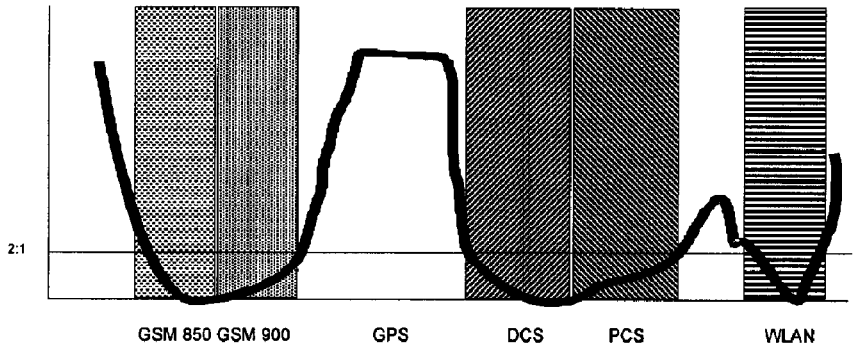
FIG. 5*c* illustrates a sample voltage standing wave ratio (VSWR) for a quad band antenna that has had its customizable plate imprinted with the metallization pattern of FIG. 3*c*.

FIG. 5*c* illustrates a VSWR for a quad band antenna that has had its customizable plate 16 imprinted with the metallization pattern 20*c* of FIG. 3*c*. This metallization pattern 20*c* is designed provide additional antenna coverage for WLAN frequency band applications. WLAN generally refers to the collection of RF communication protocols that utilize the less regulated 2.4 GHz frequency. These include, but are not limited to the 802.11 family of Wi-Fi protocols as well as the short range Bluetooth protocol. In this example, the metallized pattern 20*c* imprinted on the back of the customizable plate 16 changes the frequency characteristics of the antenna structure. In addition to the GSM frequency bands around 850 MHz, 900 MHz, 1800 MHz (DCS), and 1900 MHz (PCS), the graph shows that the metallized pattern 20*c* also provides for reception around 2.4 (GHz) which is the frequency utilized by applications such as WLAN and Bluetooth.

Figure 5D:
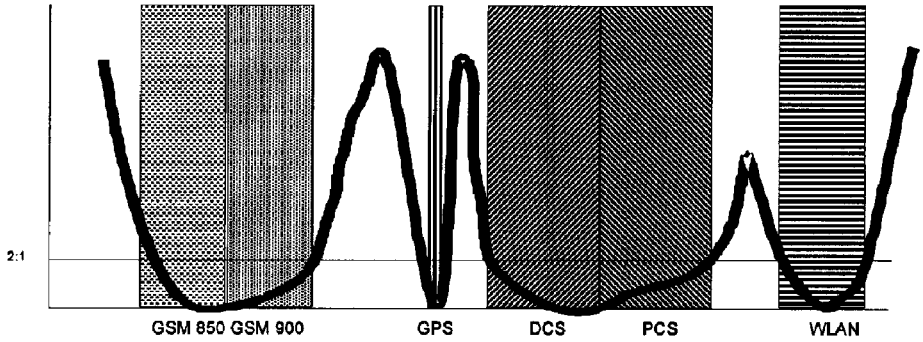
FIG. 5*d* illustrates a sample voltage standing wave ratio (VSWR) for a quad band antenna that has had its customizable plate imprinted with the metallization pattern of FIG. 3*d*.

FIG. 5*d* illustrates a VSWR for a quad band antenna that has had its customizable plate 16 imprinted with the metallization pattern 20*d* of FIG. 5*d*. This metallization pattern 20*d* is designed provide additional antenna coverage for both GPS and WLAN coverage. In this example, the metallized pattern 20*d* imprinted on the back of the customizable plate 16 changes the frequency characteristics of the antenna structure. In addition to the GSM frequency bands around 850 MHz, 900 MHz, 1800 MHz (DCS), and 1900 MHz (PCS), the graph shows that the metallized pattern 20*d* also provides for reception around 1575 (MHz) which is a frequency utilized by global positioning system (GPS) satellites and around 2.4 (GHz) which is the frequency utilized by applications such as WLAN and Bluetooth.

Thus, by varying the design of the metallization pattern 20*a-d* that can be imprinted onto the inner surface of the customizable plate 16, the overall performance characteristics of the antenna structure can be enhanced to allow for use with more applications and RF communication protocols.

The metallization patterns illustrated in FIGS. 3*a-d* are exemplary and used to illustrate certain embodiments of the present invention. Other metallization patterns not specifically described herein can be applied to a customizable plate. Thus, the present invention is not limited to the metallization patterns specifically described. One of ordinary skill in the art could readily design and apply alternate metallization patterns to a customizable plate without departing from the scope of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Although specific embodiments have been illustrated and described herein, those of ordinary skill in the art appreciate that any arrangement which is calculated to achieve the same purpose may be substituted for the specific embodiments shown and that the invention has other applications in other environments. This application is intended to cover any adaptations or variations of the present invention. The following claims are in no way intended to limit the scope of the invention to the specific embodiments described herein.

What is claimed is:

1. An antenna structure comprising:

a body portion;

an antenna element, one end of the antenna element being coupled with the body portion; and an arm support coupled between the body portion and a second end of the antenna element such that the arm support substantially fills most of an open space created inside a perimeter of the antenna element, the arm support including a recessed portion on one side located within the perimeter of the antenna element, the recessed portion adapted to receive a two-sided customizable plate.

2. The antenna structure of claim 1 wherein the customizable plate adapted to fit within the recess can be adhered to the recessed portion of the arm support.

3. The antenna structure of claim 1 wherein the customizable plate can be graphically customized to display a viewable image.

4. The antenna structure of claim 1 wherein the customizable plate is comprised of a non-metallic material that does not affect the performance characteristics of the antenna element.

5. The antenna structure of claim 1 wherein the customizable plate is comprised of a non-metallic material and further includes an imprinted metalized pattern on the side that faces the recessed portion when seated in the arm support, wherein the imprinted metalized pattern beneficially affects the performance characteristics of the antenna element.

6. An arm support that can be coupled with an antenna structure that is comprised of a body portion and an antenna element, the arm support capable of being coupled between the body portion and an end of the antenna element and comprising a nonmetallic material having a recessed portion on one side adapted to receive a two-sided customizable plate, the arm support substantially filling an open space created inside a perimeter of the antenna element.

7. The arm support of claim 6 wherein the customizable plate adapted to fit within the recessed portion can be adhered to the recessed portion of the arm support.

8. The arm support of claim 6 wherein the customizable plate can be graphically customized to display a viewable image.

9. The arm support of claim 6 wherein the customizable plate is comprised of a non-metallic material that does not affect the performance characteristics of the antenna element.

10. The arm support of claim 6 wherein the customizable plate is comprised of a non-metallic material and further includes an imprinted metalized pattern on the side that faces the recessed portion when seated in the arm support, wherein the imprinted metalized pattern beneficially affects the performance characteristics of the antenna element.

* * * * *